US011230106B2

(12) United States Patent
Kato et al.

(10) Patent No.: US 11,230,106 B2
(45) Date of Patent: Jan. 25, 2022

(54) PRINTING APPARATUS

(71) Applicant: SEIKO EPSON CORPORATION, Tokyo (JP)

(72) Inventors: Junya Kato, Matsumoto (JP); Akira Mashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/063,851

(22) Filed: Oct. 6, 2020

(65) Prior Publication Data

US 2021/0101387 A1 Apr. 8, 2021

(30) Foreign Application Priority Data

Oct. 8, 2019 (JP) ..... JP2019-185026

(51) Int. Cl.
*B41J 2/165* (2006.01)

(52) U.S. Cl.
CPC ..... *B41J 2/16535* (2013.01); *B41J 2/16505* (2013.01); *B41J 2/16508* (2013.01); *B41J 2002/1655* (2013.01)

(58) Field of Classification Search
CPC B41J 2/16535; B41J 2/16505; B41J 2/16508; B41J 2002/1655; B41J 29/02; B41J 2/17509; B41J 2/16526
See application file for complete search history.

(56) References Cited

U.S. PATENT DOCUMENTS

2015/0273838 A1* 10/2015 Shindo ..... B41J 29/17 347/33

FOREIGN PATENT DOCUMENTS

JP 2004-338223 12/2004
JP 2018-034413 3/2018

* cited by examiner

*Primary Examiner* — Geoffrey S Mruk
(74) *Attorney, Agent, or Firm* — Workman Nydegger

(57) ABSTRACT

A printing apparatus is a serial-type printing apparatus including a discharge head configured to discharge a liquid (ink) toward a medium, a carriage configured to reciprocate in a scanning direction in a state of supporting the discharge head, and a platen configured to guide transport of the medium, and a maintenance unit is installed sandwiching the platen from both sides in the scanning direction and configured to maintain performance of the discharge head.

6 Claims, 6 Drawing Sheets

PRINTING APPARATUS

The present application is based on, and claims priority from JP Application Serial Number 2019-185026, filed Oct. 8, 2019, the disclosure of which is hereby incorporated by reference herein in its entirety.

BACKGROUND

1. Technical Field

The disclosure relates to a printing apparatus.

2. Related Art

In a known printer in which a serial-type large carriage equipped with a plurality of discharge heads is mounted, a large maintenance unit is required in accordance with the number of discharge heads. In an inkjet printer in JP-A-2004-338223, a maintenance unit, such as a capping unit that covers a nozzle surface with a cap in order to suppress nozzle clogging due to drying during printing standby of the discharge head or stop of printing, and a wiping unit that wipes ink adhering to the nozzle surface with a cloth, is installed on one side of a platen in a scanning direction of a carriage.

SUMMARY

As described above, in JP-A-2004-338223, the capping unit and the wiping unit are installed on one side of the platen. Thus, when maintenance of the carriage is performed, space acquired by adding a lateral width of the capping unit and a lateral width of the wiping unit is required on one side of the platen. However, since the capping unit is in a form of covering the entire discharge head, a planar space that is generally equal to that of the carriage is required. Further, the wiping unit can efficiently perform wiping when the wiping unit is configured with a lateral width that is generally equal to that of the carriage depending on a way of wiping. Note that, since the carriage reciprocates and performs printing, space corresponding to the lateral width of the carriage is also required on the other side of the platen such that the carriage can move to a position completely falling outside the platen. In this way, in a printing apparatus in which a serial-type large carriage equipped with a plurality of discharge heads is mounted, there is a problem that the printing apparatus increases in size in the scanning direction when a maintenance unit is disposed.

A printing apparatus that is a serial-type printing apparatus includes a discharge head configured to discharge a liquid toward a medium, a carriage configured to reciprocate in a scanning direction in a state of supporting the discharge head, and a platen configured to guide transport of the medium, where a maintenance unit is installed sandwiching the platen from both sides in the scanning direction thereof and configured to maintain performance of the discharge head.

In the printing apparatus described above, the maintenance unit may include a capping unit configured to cover the discharge head and suppress drying of the liquid, installed on one of the sides sandwiching the platen, and a wiping unit configured to wipe the liquid adhering to the discharge head, installed on the other of the sides sandwiching the platen.

In the printing apparatus described above, a scanning start region that serves as a base point of scanning of the carriage may be set on either of the sides sandwiching the platen in the scanning direction, and the wiping unit may be installed on a side of the scanning start region.

In the printing apparatus described above, the wiping unit may be configured as a cloth wiper, and move in a direction intersecting the scanning direction to perform maintenance.

In the printing apparatus described above, a flushing reception unit configured to receive the liquid discharged from the discharge head immediately before the liquid is discharged toward the medium may be further installed as the maintenance unit on the side of the scanning start region.

In the printing apparatus described above, a pressure flushing reception unit configured to receive the liquid pressurized and discharged from the discharge head may be further installed as the maintenance unit on the side of the scanning start region, and the pressure flushing reception unit may be installed aligned with the wiping unit in a direction intersecting the scanning direction.

In the printing apparatus described above, a liquid storage unit configured to store the liquid received by the pressure flushing reception unit may be installed on the side of the scanning start region.

DESCRIPTION OF EXEMPLARY EMBODIMENTS

1. EXEMPLARY EMBODIMENT

Figure 1:
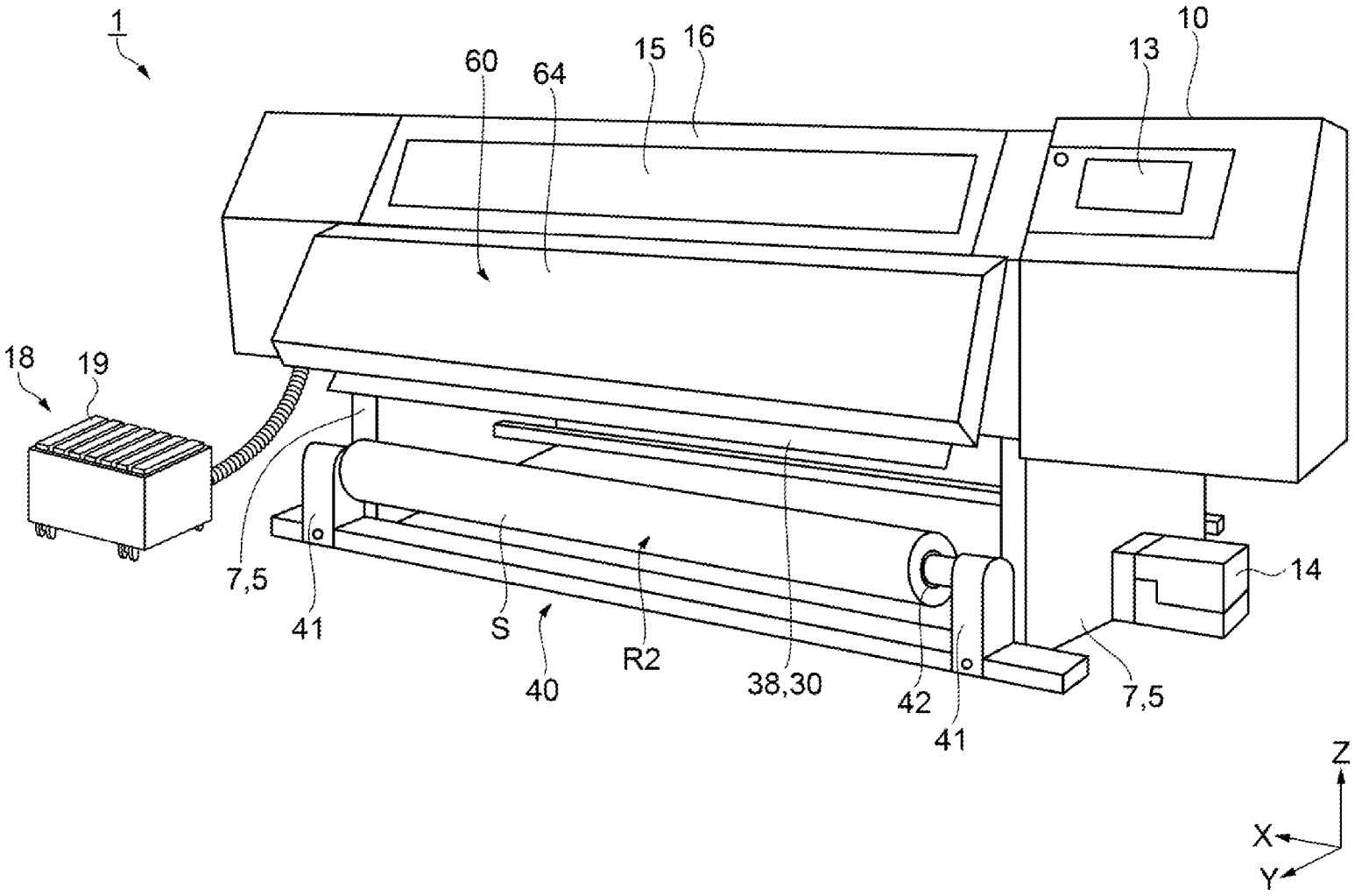
FIG. 1 is a schematic perspective view illustrating a configuration of a printing apparatus according to an exemplary embodiment.
Figure 2:
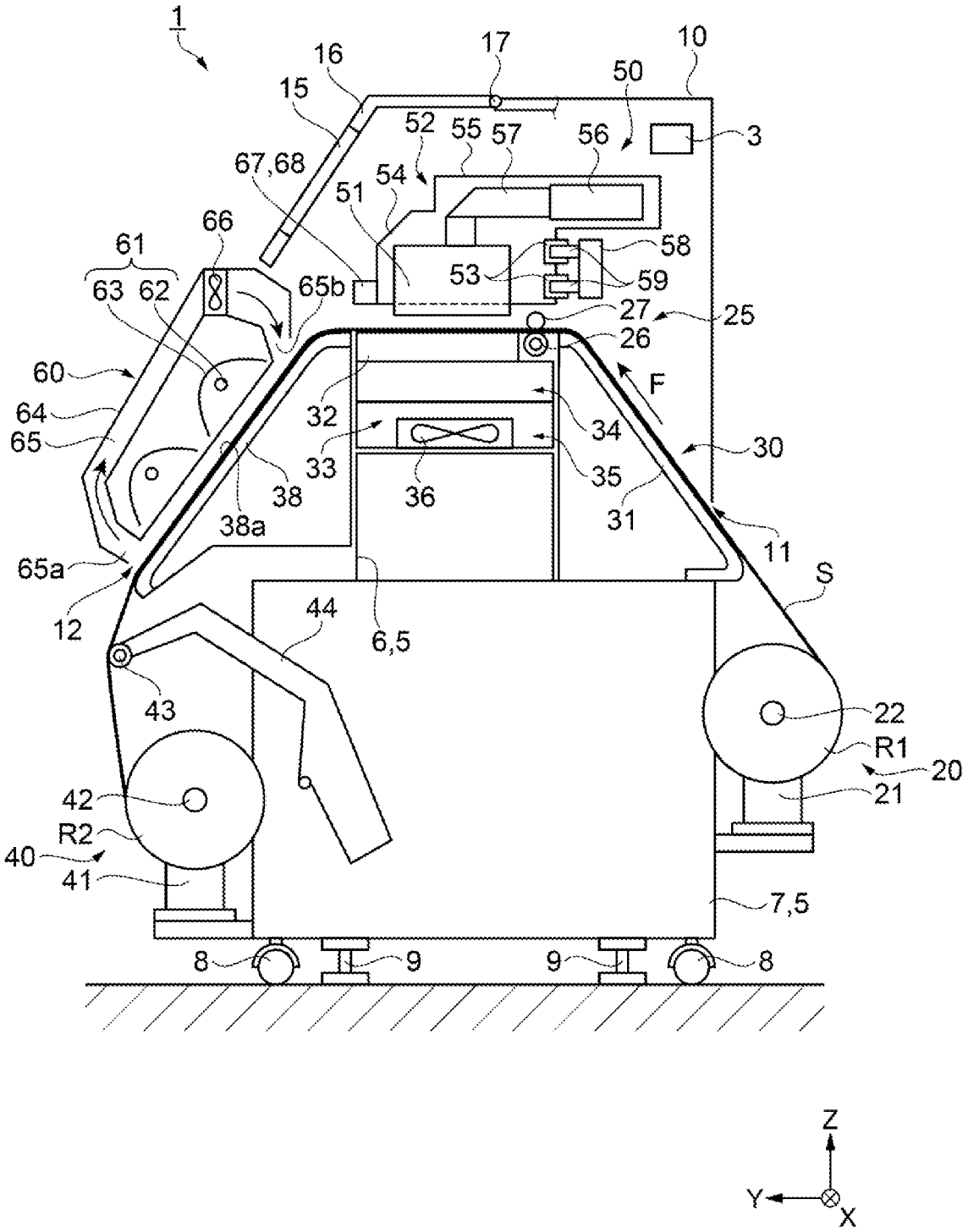
FIG. 2 is a schematic cross-sectional view illustrating the configuration of the printing apparatus.

FIG. 1 is a schematic perspective view illustrating a configuration of a printing apparatus 1 according to the present exemplary embodiment. FIG. 2 is a schematic cross-sectional view illustrating the configuration of the printing apparatus 1.

As illustrated in FIGS. 1 and 2, the printing apparatus 1 according to the present exemplary embodiment is a serial-type large format printer (LFP) configured to handle an elongated medium S that is one example of a medium.

Note that the drawings including FIG. 1 are illustrated using an XYZ coordinate system. A Z direction is a direction along a gravitational direction and a vertical direction. Hereinafter, the Z direction is also referred to as an up-down direction or a height direction. An X direction intersects (in the present exemplary embodiment, is orthogonal to) the up-down direction and is a longitudinal direction of a housing 10. Hereinafter, the X direction is also referred to as a width direction or a scanning direction. A Y direction is a direction that intersects (in the present exemplary embodiment, is orthogonal to) both the up-down direction and the width direction. Hereinafter, the Y direction is also referred to as a front-back direction.

Further, in the front-back direction, an apparatus front side or an apparatus forward side of the printing apparatus 1 is set as the +Y direction, and an apparatus back side or an apparatus rear side is set as the −Y direction. Further, in the width direction, an apparatus left side is set as the +X direction, and an apparatus right side is set as the −X direction when the printing apparatus 1 is viewed from the front side. Further, in the up-down direction, an apparatus upper side, an upward direction, an upper portion, an upper surface, and the like are set as the +Z direction, and an apparatus lower side, a lower direction, a lower portion, a lower surface, and the like are set as the −Z direction. Note that the Y direction corresponds to a transport direction F in a printing unit 50. In addition, a positional relationship along the transport direction F of the medium S for printing is also referred to as upstream or downstream.

The printing apparatus 1 includes a supply unit 20, a transport unit 25, a guide unit 30, a winding unit 40, the printing unit 50, a heating unit 60, a control unit 3, a maintenance unit 100 (see FIG. 3), and the like. The supply unit 20, the transport unit 25, the guide unit 30, the winding unit 40, the heating unit 60, and the maintenance unit 100 are fixed to a frame 5. The frame 5 includes a base frame 6 extending in the width direction, a pair of leg frames 7 that extend in the up-down direction and the front-back direction integrally with the base frame 6, receive a weight of the printing apparatus 1, and are formed in a left-right direction, and the like.

The printing unit 50 is installed inside the housing 10 that is fixed to the frame 5 and has a substantially rectangular parallelepiped shape elongated in the width direction. The control unit 3 is provided inside the housing 10, and comprehensively controls an operation of each of the units of the printing apparatus 1.

An operating panel 13 for performing a setting operation and an input operation is installed on the upper right portion of the housing 10. Note that the operating panel 13 is electrically coupled to the control unit 3. On the lower right portion of the housing 10, a waste liquid tank 14 is provided as a liquid storage unit that accommodates ink disposed of in the maintenance unit 100 (in the present exemplary embodiment, a pressure flushing reception unit 85).

An open/close cover 16 including a checking window 15 having a width equivalent to a length of a platen 32 in the width direction is provided on the upper central portion of the housing 10. The open/close cover 16 is rotatably formed with a rotational movement shaft 17 in the width direction with respect to the housing 10. A user can check a printing status inside the printing apparatus 1 from the checking window 15, and when a malfunction or the like of a printing operation occurs, the user can stop the printing operation and open the open/close cover 16 to make an adjustment or the like.

The printing apparatus 1 includes a pair of casters 8 and a pair of adjusters 9 each at a lower end of the frame 5 formed in the left-right direction. An installation operator can move the printing apparatus 1 to an installation place by the casters 8. Further, after the installation operator moves the printing apparatus 1 to the installation place, the installation operator performs a height adjustment (such as a horizontal adjustment) of the printing apparatus 1 by the adjusters 9, and fixes the printing apparatus 1 to the floor surface.

The supply unit 20 is provided on a rear lower portion of the housing 10. The supply unit 20 includes a pair of holders 21 that sandwich both ends of a core tube 22. A roll body R1 of the unused medium S for printing wound on the core tube 22 is held in the holders 21. One of the holders 21 is provided with a motor (not illustrated) that supplies rotary power to the core tube 22. The motor is driven to rotate the core tube 22, and thus the medium S unwound from the roll body R1 is fed to the printing unit 50. Note that the roll body R1 multi-sized and formed with the medium S having a different width and a different number of times of winding is replaceably loaded to the supply unit 20.

The winding unit 40 is provided on a front lower portion of the housing 10. The winding unit 40 includes a pair of holders 41 that sandwich both ends of a core tube 42. A roll body R2 formed by winding the medium S printed by the printing unit 50 around the core tube 42 is held in the holders 41. One of the holders 41 is provided with a motor (not illustrated) that supplies rotary power to the core tube 42. When the motor is driven to rotate the core tube 42, the medium S is wound around the core tube 42.

The winding unit 40 includes a tension roller 43.

The tension roller 43 is supported by a rocking frame 44, contacts and presses, in the width direction, a back surface of the medium S hanging down under its own weight, and applies tension to the medium S wound around the core tube 42. The tension roller 43 is formed so as to be longer than a width of the medium S in the width direction. The tension roller 43 is provided downstream of the heating unit 60 described later in the transport direction F.

The guide unit 30 includes an upstream guiding unit 31, the platen 32, and a downstream guiding unit 38. The platen 32 is formed in a long plate shape in the scanning direction and is installed at a position facing the printing unit 50. The platen 32 supports the medium S printed by the printing unit 50 from below, and guides the transport. The upstream guiding unit 31 is provided upstream of the platen 32.

Further, a supplying port 11 for supplying the medium S into the housing 10 is formed at a position on the upper side of the upstream guiding unit 31 on the rear side of the housing 10. The upstream guiding unit 31 guides the medium S supplied from the supply unit 20 to the platen 32 via the supplying port 11.

The downstream guiding unit 38 is provided downstream of the platen 32. Further, a discharge port 12 for discharging the medium S to the outside of the housing 10 is formed at a position on the upper side of the downstream guiding unit 38 on the front side of the housing 10. The downstream guiding unit 38 guides the medium S printed by the printing unit 50 to the winding unit 40 via the discharge port 12.

The transport unit 25 includes a driven roller 27 that is disposed on the upper side of a driving roller 26 disposed on the lower side of the medium S upstream of the platen 32 and driven in rotation, and rotates in accordance with the rotation of the driving roller 26, and a motor (not illustrated) that supplies rotary power to the driving roller 26.

Specifically, the driving roller 26 is configured to extend in a direction intersecting the transport direction F of the medium S. The driving roller 26 is provided between the platen 32 and the upstream guiding unit 31. The driven roller 27 is configured to be movable so as to be separated from or pressed against the driving roller 26. When the motor is driven and the driving roller 26 is driven in rotation, the medium S sandwiched between the driving roller 26 and the driven roller 27 is transported in the transport direction F.

A suction configuration unit 33 having a box shape is installed on a lower portion of the platen 32. Then, the platen 32 and the suction configuration unit 33 constitute a negative pressure chamber 34. In addition, the suction configuration unit 33 constitutes a suction chamber 35 that communicates with the negative pressure chamber 34. Then, an exhaust fan 36 for discharging air inside the suction chamber 35 to the outside and forming negative pressure in the suction chamber 35 and the negative pressure chamber 34 is installed in the suction configuration unit 33.

Figure 3:
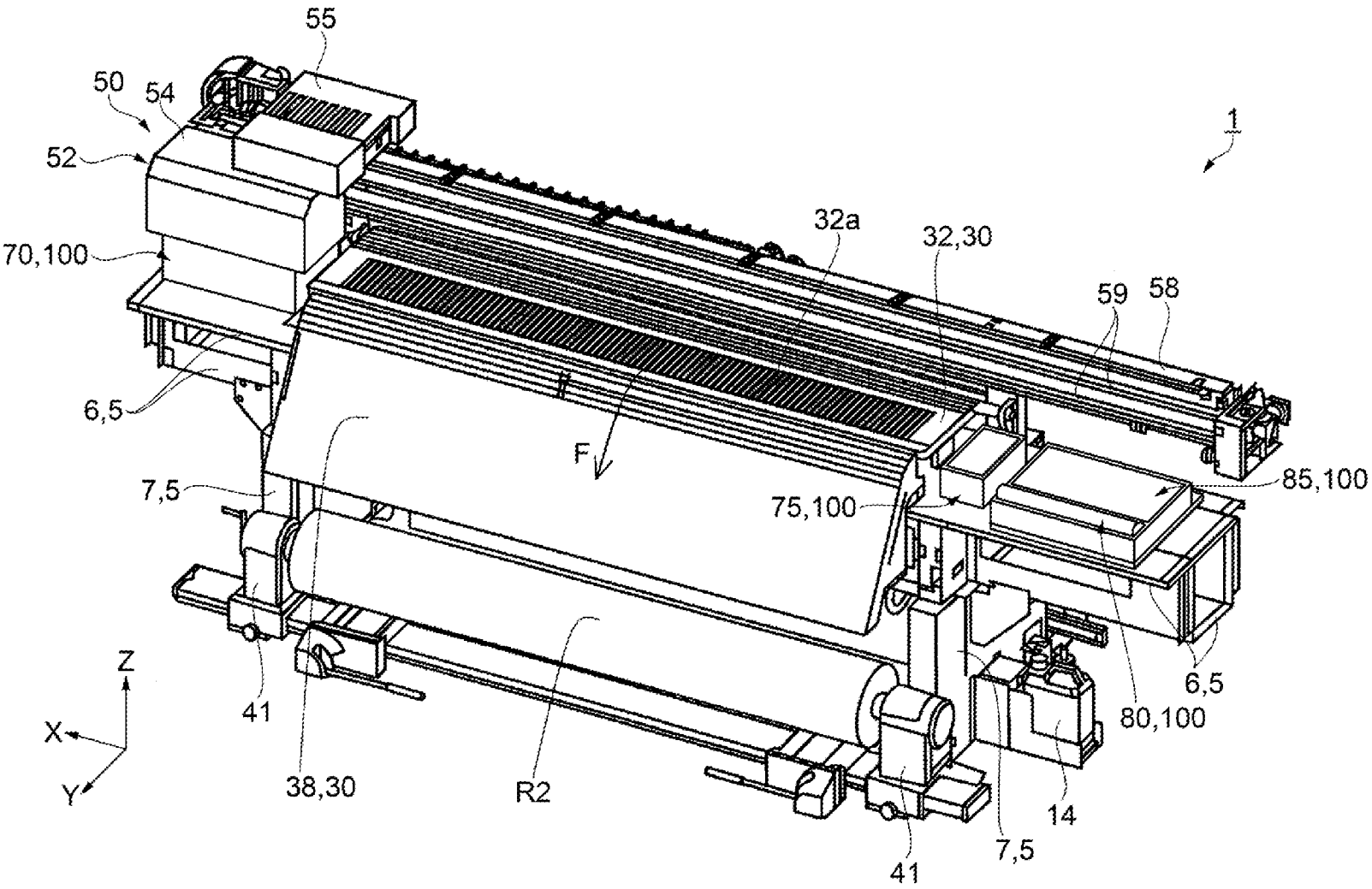
FIG. 3 is a schematic perspective view illustrating a configuration of a maintenance unit.

A plurality of suction holes 32*a* (see FIG. 3) that communicate with the negative pressure chamber 34 are installed in the platen 32. When the medium S is sandwiched between the driving roller 26 and the driven roller 27 and transported on the platen 32, the medium S is continuously transported in the transport direction F while being sucked into the suction holes 32*a*. In the present exemplary embodiment, by installing the suction configuration unit 33, floating of the medium S during printing is prevented, and occurrence of image unevenness is suppressed. In the present exemplary embodiment, as illustrated in FIG. 3, the plurality of suction holes 32*a* are formed along the transport direction F, and the plurality of suction holes 32*a* formed in the transport direction F are also aligned in a row in the width direction.

The printing unit 50 is disposed above and faces the platen 32. The printing unit 50 includes a discharge head 51 that discharges ink as a liquid toward the medium S sucked on the platen 32, and a carriage 52 that freely reciprocates in the scanning direction orthogonal to the transport direction F of the medium S while supporting the discharge head 51.

The discharge head 51 includes a plurality of nozzles (not illustrated), and is configured to be able to discharge the ink. Specifically, the discharge head 51 is configured such that the plurality of nozzles are aligned in a direction orthogonal to the scanning direction. Then, each discharge head 51 is installed so as to be aligned in the width direction (scanning direction) for each color.

The carriage 52 is supported so as to freely reciprocate with respect to two carriage shafts 59 that are installed on the carriage frame 58 and extend in the width direction. As illustrated in FIG. 2, the carriage 52 and the carriage shafts 59 in the present exemplary embodiment are engaged with each other via two bearings 53 fixed to the carriage 52, and the carriage 52 moves with respect to the carriage shafts 59. Note that the bearings 53 are configured as so-called ball bearings. The carriage 52 in the present exemplary embodiment has a weight of several tens of kilograms. However, by using the two carriage shafts 59, the carriage 52 can be prevented from rotating about the shaft and suppress an influence such as vibration, and can also smoothly reciprocate with respect to the carriage shafts 59 by the bearings 53.

When a printing instruction is input via the operating panel 13, the control unit 3 causes printing to be performed on the medium S by comprehensively controlling driving of each of the configurations of the printing apparatus 1. Specifically, the control unit 3 causes printing to be performed on the medium S by alternately performing a transport operation of driving the driving roller 26 to transport the medium S by a unit transport amount in the transport direction F, and a discharging operation of discharging ink from the discharge head 51 while moving the carriage 52 in the scanning direction. When the discharge head 51 discharges the ink toward the medium S, the discharge head 51 and the platen 32 are disposed relative to each other.

The carriage 52 includes a carriage case 54 configured substantially in a box shape. In addition, the carriage 52 holds a circuit case 55 on an upper portion of the carriage case 54. Therefore, the circuit case 55 also reciprocates in the scanning direction by the carriage 52 reciprocating in the scanning direction.

The circuit case 55 is configured in a box shape, and a printed wired board such as a plurality of head driving substrates 56 is installed inside the circuit case 55. The plurality of head driving substrates 56 are electrically coupled to the respective corresponding discharge heads 51 via a coupling cable 57. Note that the coupling cable 57 couples the head driving substrates 56 to the discharge heads 51 located below the front side of the head driving substrates 56 by using a flexible flat cable (FFC) in a form of being folded back.

Note that a head control board (not illustrated) is also installed inside the circuit case 55. The head control board is electrically coupled to the control unit 3 fixedly disposed inside the housing 10 via the FFC (not illustrated) that deforms in conformance with movement of the carriage 52 (not illustrated). In addition, a temperature sensor (not illustrated) and the like are mounted inside the circuit case 55, and a sub-board (not illustrated) that complements an operation of each of the boards is also installed.

The head control board (not illustrated) receives an input of a control signal from the control unit 3, generates a control waveform that controls a shape of a driving waveform output from the head driving substrates 56, timing of outputting the driving waveform, or the like, outputs the control waveform to each of the head driving substrates 56, and thus controls the discharge head 51.

The head driving substrates 56 generate a driving waveform in accordance with a control waveform input from the head control board, output the driving waveform to the discharge head 51 (specifically, an actuator (not illustrated)), and discharge ink from the nozzle corresponding to the actuator. For example, the head driving substrates 56, when discharging a large ink droplet from the nozzle is desired, input a driving waveform with large amplitude to the actuator. Further, the head driving substrates 56, when discharging a small ink droplet from the nozzle is desired, input a driving waveform with small amplitude to the actuator.

Note that the head driving substrates 56 are installed so as to correspond to the type and color of ink used for printing, and seven head driving substrates 56 are installed in the present exemplary embodiment. In other words, the head driving substrates 56 are installed so as to correspond to the number of discharge heads 51 to be used.

The heating unit 60 rapidly dries and fixes ink in the present exemplary embodiment that requires penetrating drying and evaporation drying to the medium S by heating the medium S so as to prevent bleed-through and feathering, thereby increasing the image quality. The heating unit 60 heats the printed medium S at a position downstream of the position where the printing unit 50 is installed in the transport direction F. The heating unit 60 is installed above the downstream guiding unit 38 so as to face the medium S that is being supported and transported on a support surface 38*a* of the downstream guiding unit 38. The heating unit 60 dries the ink by heating the medium S from the front side, which is the printing surface side, of the medium S.

The heating unit 60 includes two infrared heaters 61, a heating housing 64, a duct 65, a suction fan 66, and the like. The infrared heater 61 includes an infrared irradiation unit 62, a reflecting plate 63, and the like. The infrared heater 61 is disposed to irradiate the medium S that is being transported on the support surface 38*a* not only with direct light from the infrared irradiation unit 62 but also with light reflected by the reflecting plate 63. In the present exemplary embodiment, the infrared heater 61 performs irradiation with infrared rays as electromagnetic waves.

The heating housing 64 is a box-shaped cover that supports the infrared heater 61 therein, and is provided so as to cover the infrared heater 61. The heating housing 64 is installed so as to cover the medium S on the support surface 38*a* in a drying region for drying the medium S. The duct 65 is formed inside the heating housing 64, and the suction fan 66 and the like are provided in the duct 65.

The suction fan 66 sucks, from a suction port 65*a* of the duct 65, evaporative gas (or water vapor in the case of aqueous ink) that is generated when the medium S on the support surface 38*a* is heat-dried together with an atmosphere of the evaporative gas. Then, the evaporative gas sucked in the suction fan 66 is liquefied (or dehumidified through collection of moisture in the case of aqueous ink) in the duct 65, and gas (gas having been subjected to liquefaction of evaporative gas) is sent from an exhaust port 65*b* of the duct 65. The sent gas is directed toward the medium S on the support surface 38*a*. The directed gas also facilitates the drying of the medium S.

A cutting unit 67 is configured at a left end portion on the front side of the carriage case 54. The cutting unit 67 includes a cutter blade 68 including a disk-shaped driving blade (not illustrated) that rotates about a shaft along the front-back direction (Y direction), and a disk-shaped driven blade (not illustrated) that rotates in accordance with the rotation of the driving blade. The driving blade and the driven blade are located such that the driving blade is located below the driven blade in the up-down direction. Then, the driving blade and the driven blade are disposed such that a cutting edge that is an upper portion of the driving blade and a cutting edge that is a lower portion of the driven blade overlap each other. When a cutting instruction is transmitted from the control unit 3, the cutting unit 67 is driven by the movement of the carriage 52 in the scanning direction, and rotates and moves in the scanning direction with the driving blade and the driven blade sandwiching the medium S, thereby cutting the medium S.

A container box 18 that accommodates a liquid accommodating container 19 filled with ink is provided in a lower portion of the housing 10 on the left side of the apparatus separately from the housing 10 and the frame 5. The container box 18 accommodates the plurality of liquid accommodating containers 19 corresponding to the type and color of the ink used in the printing apparatus 1. Note that seven liquid accommodating containers 19 are accommodated in the present exemplary embodiment.

A first supply tube (not illustrated) that supplies the ink corresponding to each of the discharge heads 51 is provided inside the carriage 52. Note that the first supply tube and the liquid accommodating container 19 illustrated in FIG. 1 are coupled to each other by a second supply tube (not illustrated). The second supply tube has flexibility that deforms in conformance with the carriage 52 that reciprocates in the scanning direction. These tubes supply the ink in the liquid accommodating container 19 to the discharge head 51.

Figure 4:
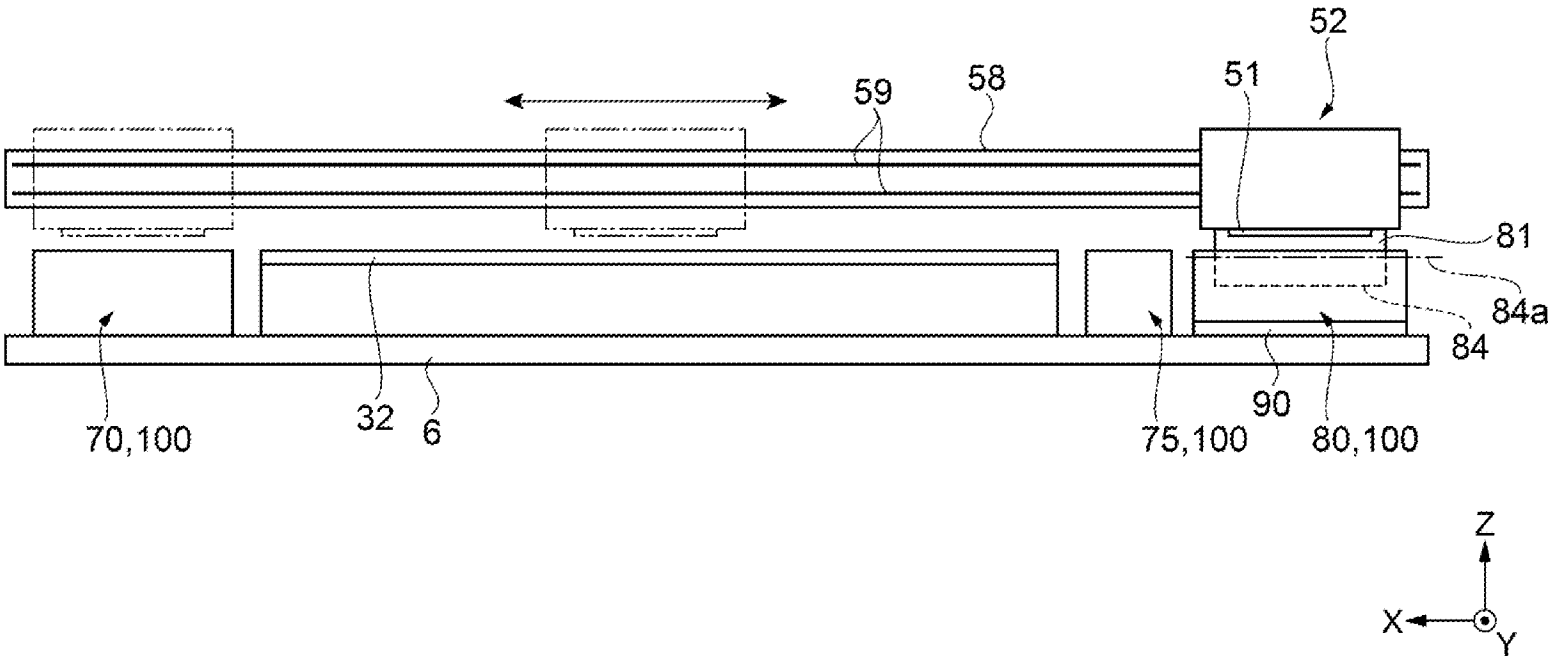
FIG. 4 is a schematic front view illustrating the configuration of the maintenance unit and an operating range of a carriage.
Figure 5:
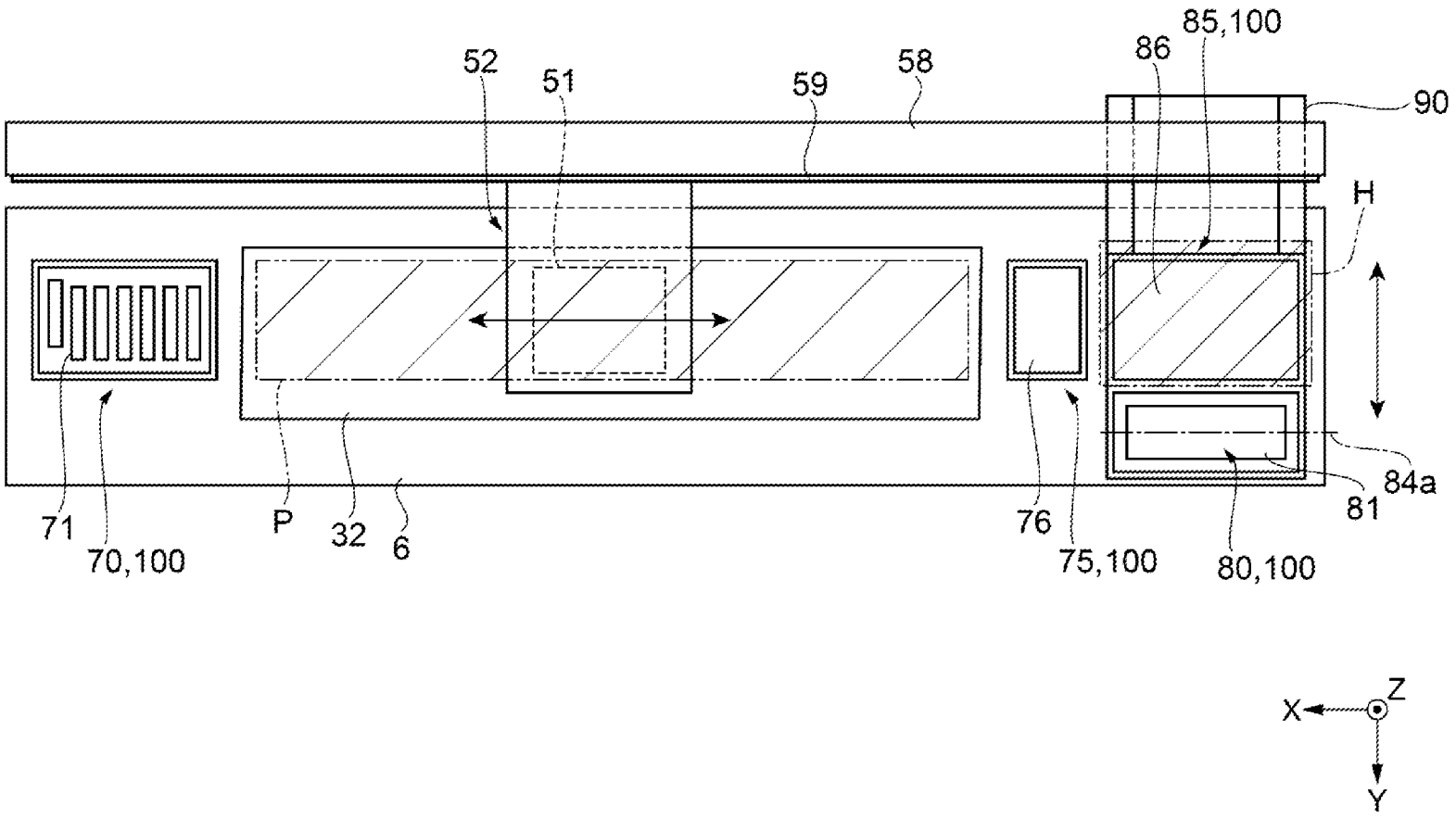
FIG. 5 is a schematic plan view illustrating the configuration of the maintenance unit and the operating range of the carriage.

FIG. 3 is a schematic perspective view illustrating a configuration of the maintenance unit 100. In FIG. 3, for convenience of description, components such as the housing 10, the heating unit 60, and the container box 18 are removed. FIG. 4 is a schematic front view illustrating the configuration of the maintenance unit 100 and an operating range of the carriage 52. FIG. 5 is a schematic plan view illustrating the configuration of the maintenance unit 100 and the operating range of the carriage 52.

In the printing apparatus 1, the discharge head 51 discharges ink toward the medium S sucked on the platen 32 extending in the scanning direction while the carriage 52 is scanning and moving in the X direction. Note that FIG. 5 illustrates, as a printing region P, a range in which the carriage 52 performs printing on the medium S on the platen 32.

The carriage shafts 59 extend to regions falling outside the printing region P in the left-right direction, and the carriage 52 is movable to the outside of the printing region P. Then, as illustrated in FIG. 5, in the present exemplary embodiment, a scanning start region H that serves as a base point of scanning when the carriage 52 performs printing is set in the region falling outside the printing region P to the right. Note that the roll body R1 can use the plurality of media S having different lengths in the width direction, and at this time, the media S are installed with reference to the printing region P on the scanning start region H side as a reference in the width direction.

In the present exemplary embodiment, as illustrated in FIGS. 4 and 5, the scanning start region H is a region set above the pressure flushing reception unit 85 constituting the maintenance unit 100 described below. A position sensor (not illustrated) is provided in the scanning start region H, and the position sensor transmits position information indicating that the carriage 52 is located in the scanning start region H to the control unit 3 when the carriage 52 moves and reaches the scanning start region H.

In the present exemplary embodiment, the maintenance unit 100 that maintains performance of the discharge head 51 is installed sandwiching the platen 32 from both sides thereof in the scanning direction. In the present exemplary embodiment, as the maintenance unit 100, a total of four of a capping unit 70, a flushing reception unit 75, a wiping unit 80, and the pressure flushing reception unit 85 is provided. Note that the maintenance unit 100 is fixed to the base frame 6 at each place.

The capping unit 70 is installed on the left side that is one of the sides of the platen 32. The capping unit 70 is a unit that puts a cap 71 (see FIG. 5) on the discharge head 51 for each color and brings the cap 71 into intimate contact with a nozzle surface (not illustrated) of the discharge head 51 for the purpose of preventing the ink of the discharge head 51 from drying and then thickening or solidifying during a period in which printing is not performed.

The flushing reception unit 75 is installed on the right side that is the other side of the platen 32. In addition, the flushing reception unit 75 is installed in the immediate vicinity of the printing region P on the scanning start region H side, that is, in the immediate vicinity of the right side of the platen 32. The flushing reception unit 75 is a unit that receives ink discharged by performing a flushing operation.

Note that the flushing operation is an operation of eliminating a malfunction, such as clogging of the nozzle, by forcibly discharging the ink from the discharge head 51 immediately before the carriage 52 discharges the ink toward the medium S and starts printing. Note that an ink absorbent body 76 is disposed as one example in the flushing reception unit 75 so as to absorb the discharged ink.

In the present exemplary embodiment, the flushing operation is performed every pass (1 pass, 3 passes, 5 passes, and the like) in which printing starts from the scanning start region H side. Note that the discharge head 51 on which the flushing operation is performed starts discharging for printing in the printing region P.

In the present exemplary embodiment, the flushing operation is performed for each discharge head 51, thereby shortening a length of the flushing reception unit 75 in the scanning direction. Note that the discharge head 51 that is located in the printing region P and starts printing and the discharge head 51 that is located on the flushing reception unit 75 and performs flushing are present in the carriage 52.

The wiping unit 80 and the pressure flushing reception unit 85 are installed side by side in the direction intersecting the scanning direction on the right side of the flushing reception unit 75 on the right side that is the other side of the platen 32. In other words, the wiping unit 80 and the pressure flushing reception unit 85 are installed on the scanning start region H side.

As illustrated in FIGS. 3 and 5, the wiping unit 80 is located on the front side of the pressure flushing reception unit 85. The pressure flushing reception unit 85 is located relative to the scanning start region H. Note that the wiping unit 80 and the pressure flushing reception unit 85 are integrally installed on the upper surface of a rail member 90 installed on the upper surface of the base frame 6. The rail member 90 is a member that moves the wiping unit 80 and the pressure flushing reception unit 85 in a direction (front-back direction) intersecting the scanning direction.

The pressure flushing reception unit 85 is a unit that receives ink discharged by performing a pressure flushing operation. Note that the pressure flushing operation is an operation of circulating ink in a flow path (not illustrated) leading to the nozzle and the like by applying pressure and forcibly discharging (pressurizing and discharging) the ink from the discharge head 51 in a case of initial filling of the ink into the discharge head 51, when there is a period of time since previous printing, by a user instruction, or the like, and of causing an appropriate amount of the ink to be discharged at appropriate concentration.

Note that a bag-shaped reception member 86 is disposed as one example in the pressure flushing reception unit 85 so as to receive the discharged ink. Note that the bag-shaped reception member 86 flows the received ink as a waste liquid into the waste liquid tank 14 provided on the scanning start region H side via a flow path (not illustrated).

The wiping unit 80 is a unit that removes ink adhering to the nozzle surface by performing a wiping operation of wiping or scraping ink adhering to the nozzle surface when the ink is discharged. The wiping unit 80 in the present exemplary embodiment is configured as a cloth wiper 81.

Figure 6:
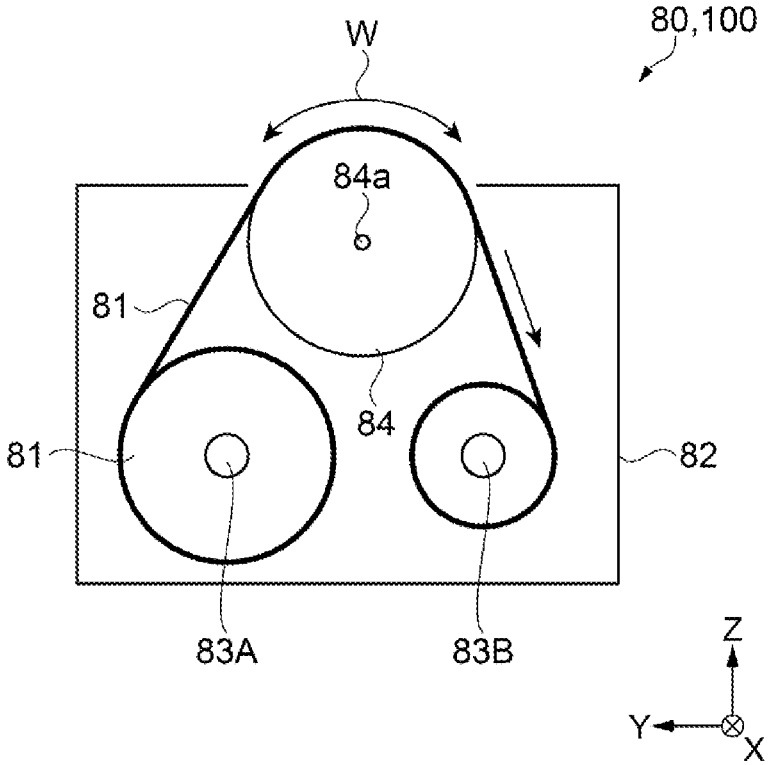
FIG. 6 is a schematic cross-sectional view illustrating a configuration of a wiping unit.

FIG. 6 is a schematic cross-sectional view illustrating a configuration of the wiping unit 80.

As illustrated in FIG. 6, the wiping unit 80 includes the cloth wiper 81, a material feeding roller 83A, a material removing roller 83B, a press roller 84, a housing 82, a wiper unit driving mechanism (not illustrated), and the like.

The material feeding roller 83A and the material removing roller 83B including a shaft in the X direction are accommodated inside the housing 82 at a distance therebetween in the Y direction. The cloth wiper 81 that wipes ink remaining on the nozzle surface is hung between the material feeding roller 83A and the material removing roller 83B. The material feeding roller 83A feeds the unused cloth wiper 81 wound in a roll shape. The material removing roller 83B winds the used cloth wiper 81 fed from the material feeding roller 83A and used for wiping.

The press roller 84 including a rotary shaft 84*a* substantially parallel to the material feeding roller 83A and the material removing roller 83B is exposed upward from the housing 82 in the upper portion of the housing 82. The cloth wiper 81 fed from the material feeding roller 83A is wound onto the press roller 84 and is wound around the material removing roller 83B after use. Therefore, when the wiping operation is performed, the cloth wiper 81 supported by the press roller 84 rotates while always exposing a region of the new cloth wiper 81 to a wiping region W.

The wiper unit driving mechanism performs rotational driving of the material feeding roller 83A and the material removing roller 83B. Further, the wiper unit driving mechanism moves (reciprocates) the wiping unit 80 in conjunction with the pressure flushing reception unit 85 via the rail member 90 to the back side intersecting the scanning direction and to the front side. As a result, the cloth wiper 81 wipes ink adhering to the nozzle surface while pressing the nozzle surface of the carriage 52 that stops in the scanning start region H from the lower side and also rotating.

The wiping unit 80 operates not only when the pressure flushing operation is performed, but also at regular intervals, by a user instruction, or the like. Ink, dust, and the like adhering to the nozzle surface can be wiped by the operation of the wiping unit 80.

The printing operation by the carriage 52 will be briefly described.

When the carriage 52 performs printing, the carriage 52 moves away from the capping unit 70 located on the left side of the platen 32 (at the left end portion of the base frame 6) and moves to the scanning start region H that serves as a base point of scanning of the carriage 52 set on the right side of the platen 32 (at the right end portion of the base frame 6). When the carriage 52 moves to the scanning start region H, the carriage 52 is located above the pressure flushing reception unit 85.

Next, the carriage 52 starts moving in the left direction. Then, when the carriage 52 moves to above the flushing reception unit 75, the carriage 52 advances the movement while sequentially discharging ink for each color from the discharge head 51 installed in the left direction of the carriage 52 toward the flushing reception unit 75. Next, the carriage 52 moves to above the platen 32, and starts printing in the first pass from the discharge head 51 located at the right end portion of the printing region P. Then, the carriage 52 performs printing while moving in the printing region P in the scanning direction. Note that the printing in the first pass is finished in a state where the discharge head 51 installed in the right direction is located at the left end portion of the printing region P. The carriage 52 that has finished the first pass passes through the left end portion of the platen 32 at that point, keeps moving, moves to above the capping unit 70, and stops.

Subsequently, the carriage 52 starts moving in the right direction, and starts printing in the second pass from the discharge head 51 located at the left end portion of the printing region P. The carriage 52 that has finished printing in the second pass passes through the right end portion of the platen 32, moves to the scanning start region H, and stops. Next, the carriage 52 starts moving in the left direction, and performs printing in the third pass by performing the flushing operation similarly to that of printing in the first pass. Hereinafter, printing is performed by repeating such operations. Note that, when the entire printing is finished, the carriage 52 moves to above the capping unit 70 and is capped by the cap 71.

Here, an outer shape of the printing apparatus 1 according to the present exemplary embodiment is roughly a height of 1580 mm by a width of 3710 mm by a depth of 1290 mm. In addition, a weight of the printing apparatus 1 is approximately 750 kg. Thus, when the printing apparatus 1 is moved during shipping and installation, a heavy machine such as a forklift is used.

In order to stably perform the transport by the forklift or the like, it is important to configure the printing apparatus 1 such that a weight balance between the left and right including the outer shape of the printing apparatus 1 is achieved, that is, such that the center of the left and right (width direction) and the center of gravity position in the width direction coincide with each other. Further, the rigidity of the frame 5 also needs to be improved in order to prevent deformation due to a shock or the like during transportation. Particularly, a configuration needs to be provided with consideration given to a bending amount of the base frame 6 when the two leg frames 7 support the base frame 6 midway, namely, a bending amount of a beam when one beam is supported at two points. Note that, when the printing apparatus 1 is lifted up by the forklift, a method for lifting up the base frame 6 from the outside of the vicinity of the left and right leg frames 7 is used in the present exemplary embodiment.

In the printing apparatus 1 according to the present exemplary embodiment, as illustrated in FIG. 3, the capping unit 70 as the maintenance unit 100 is installed on the base frame 6 on the left side of the platen 32 and on the left side of the left leg frame 7 serving as a fulcrum. The flushing reception unit 85, the wiping unit 80, and the pressure flushing reception unit 85 as the maintenance unit 100 are also installed on the base frame 6 on the right side of the platen 32 and on the right side of the right leg frame 7 serving as a fulcrum.

By installing the maintenance unit 100 in the arrangement illustrated in FIG. 3, the configuration of the printing apparatus 1 can be brought close such that the center position of a length to the left and right (in the width direction) and the center of gravity position in the width direction coincide with each other as much as possible. As a result, stable transport can be performed even when the transport is performed by the forklift or the like. Further, since the weight balance between the left and the right including the outer shape of the printing apparatus 1 can be achieved, bending of the base frame 6 can also be suppressed, and a small object can also be used as a triangular reinforcing member (a so-called bracket member) that supports the base frame 6 being installed on the leg frames 7 in order to prevent deformation due to a shock or the like during transportation.

According to the present exemplary embodiments, the following advantageous effects can be obtained.

The printing apparatus 1 according to the present exemplary embodiment includes the discharge head 51, the carriage 52, and the platen 32. Then, the maintenance unit 100 configured to maintain performance of the discharge head 51 is installed sandwiching the the platen 32 from both sides thereof in the scanning direction.

When printing is performed, the carriage 52 normally needs to move to a region outside a range of printing on both sides of the platen 32 in the scanning direction. Thus, by installing the maintenance unit 100 on both sides of the platen 32 in the scanning direction of the carriage 52, the region outside the range of printing in the scanning direction of the carriage 52 can be effectively used as compared to a configuration in which a maintenance unit is installed on only one of sides of a platen as in the related art, and thus an increase in size of the printing apparatus 1 can be suppressed.

In the printing apparatus 1 according to the present exemplary embodiment, in the maintenance unit 100, the capping unit 70 configured to cover the discharge head 51 and suppress drying of ink is installed on the left side that is one of the sides of the platen 32. Further, the wiping unit 80 configured to wipe the ink adhering to the discharge head 51 is installed on the right side that is the other side of the platen 32.

As a result, by installing the capping unit 70 and the wiping unit 80 that are the most general as the maintenance unit 100 on both sides of the platen 32 in the scanning direction, an increase in size of the printing apparatus 1 including such a maintenance unit 100 can be suppressed.

In the printing apparatus 1 according to the present exemplary embodiment, the scanning start region H that serves as a base point of scanning of the carriage 52 is set on the right side of the platen 32 in the scanning direction. Then, the wiping unit 80 is installed on the scanning start region H side.

For example, when the wiping unit 80 is not installed on the scanning start region H side, printing needs to start after wiping is performed and the carriage 52 is then moved in the scanning direction and once located in the scanning start region H. However, in the present exemplary embodiment, since the wiping unit 80 is installed on the scanning start region H side, printing can immediately start after the ink adhering to the discharge head 51 is wiped during printing, and the time from the maintenance operation to the printing operation can be shortened.

In the printing apparatus 1 according to the present exemplary embodiment, the wiping unit 80 is configured as the cloth wiper 81, and moves in a direction intersecting the scanning direction and performs maintenance, and thus the size in the scanning direction can be reduced as compared to a case in which the wiping unit 80 moves in the scanning direction and performs maintenance, and an increase in size of the printing apparatus 1 can be suppressed.

In the printing apparatus 1 according to the present exemplary embodiment, the flushing reception unit 75 configured to receive the ink discharged from the discharge head 51 immediately before the ink is discharged toward the medium S is installed on the scanning start region H side. As a result, after flushing is performed as maintenance having a high frequency of use, printing can immediately start, clogging can be prevented, and printing efficiency can be increased.

In the printing apparatus 1 according to the present exemplary embodiment, the pressure flushing reception unit 85 configured to receive the ink pressurized and discharged from the discharge head 51 is installed on the scanning start region H side, and the pressure flushing reception unit 85 is installed aligned with the wiping unit 80 in a direction intersecting the scanning direction.

As a result, the wiping unit 80 and the pressure flushing reception unit 85 are disposed side by side in the direction intersecting the scanning direction, and thus a length in the scanning direction can be shortened as compared to a case in which the wiping unit 80 and the pressure flushing reception unit 85 are installed side by side in the scanning direction.

In the printing apparatus 1 according to the present exemplary embodiment, the waste liquid tank 14 configured to store the ink received by the pressure flushing reception unit 85 is installed on the scanning start region H side.

As a result, similarly to the pressure flushing reception unit 85, by providing the waste liquid tank 14 on the scanning start region H side, the pressure flushing reception unit 85 and the waste liquid tank 14 can have shorter piping that couples therebetween and be efficiently installed, and an increase in size of the printing apparatus 1 can be suppressed.

2. MODIFICATION EXAMPLE 1

In the present exemplary embodiment, the scanning start region H is set on the right side of the platen 32. However, the present invention is not limited thereto, and the scanning start region H may be installed on the left side of the platen 32. In this case, the arrangement of the maintenance unit 100 may be reversed left to right from the present exemplary embodiment.

3. MODIFICATION EXAMPLE 2

In the present exemplary embodiment, the capping unit 70, the flushing reception unit 75, the wiping unit 80, and the pressure flushing reception unit 85 are installed as the maintenance unit 100. However, the present invention is not limited thereto, and a suction unit that eliminates clogging of the nozzle and the like by forcibly sucking the discharge head 51 may be installed. In this case, the suction unit may be installed between the flushing reception unit 75 and the pressure flushing reception unit 85. Further, in this case, a length of the suction unit in the scanning direction can be shortened by a configuration that caps the discharge head 51 for each color and sucks the discharge head 51.

4. MODIFICATION EXAMPLE 3

The wiping unit 80 according to the present exemplary embodiment uses the cloth wiper 81. However, the present invention is not limited thereto, and a rubber-based wiper may be used as a wiper.

Contents derived from the above-mentioned embodiments and modification examples are described below.

A printing apparatus that is a serial-type printing apparatus includes a discharge head configured to discharge a liquid toward a medium, a carriage configured to reciprocate in a scanning direction in a state of supporting the discharge head, and a platen configured to guide transport of the medium, where a maintenance unit configured to maintain performance of the discharge head is installed sandwiching the platen from both sides thereof in the scanning direction.

When printing is performed, the carriage normally needs to move to a region outside a range of printing on both sides of the platen in the scanning direction. Thus, by installing the maintenance unit on both sides of the platen in the scanning direction of the carriage, the region outside the range of printing in the scanning direction of the carriage can be effectively used as compared to a configuration in which a maintenance unit is installed on only one of sides of a platen as in the related art, and thus an increase in size of the printing apparatus can be suppressed.

In the printing apparatus described above, in the maintenance unit, a capping unit configured to cover the discharge head to suppress drying of the liquid may be installed on one of the sides sandwiching the platen, and a wiping unit configured to wipe the liquid adhering to the discharge head may be installed on the other of the sides sandwiching the platen.

According to the configuration, by installing the capping unit and the wiping unit that are the most general as the maintenance unit on both sides of the platen in the scanning direction, an increase in size of the printing apparatus including such a maintenance unit can be suppressed.

In the printing apparatus described above, a scanning start region that serves as a base point of scanning of the carriage may be set on either of the sides sandwiching the platen in the scanning direction, and the wiping unit may be installed on the scanning start region side.

According to the configuration, for example, when the wiping unit is not installed on the scanning start region side, printing needs to start after wiping is performed and the carriage is then moved in the scanning direction and once located in the scanning start region. However, in the present exemplary embodiment, the wiping unit is installed on the scanning start region side, and thus printing can immediately start after the ink adhering to the discharge head is wiped during printing, and the time from the maintenance operation to the printing operation can be shortened.

In the printing apparatus described above, the wiping unit may be configured as a cloth wiper, and move in a direction intersecting the scanning direction to perform maintenance.

According to the configuration, the wiping unit is configured as a cloth wiper, and moves in a direction intersecting the scanning direction and performs maintenance, and thus the size in the scanning direction can be reduced as compared to a case in which the wiping unit moves in the scanning direction and performs maintenance, and an increase in size of the printing apparatus can be suppressed.

In the printing apparatus described above, a flushing reception unit configured to receive the liquid discharged from the discharge head immediately before the liquid is discharged toward the medium may be further installed as the maintenance unit on the scanning start region side.

According to the configuration, after flushing is performed as maintenance having a high frequency of use, printing can immediately start, clogging can be prevented, and printing efficiency can be increased.

In the printing apparatus described above, a pressure flushing reception unit configured to receive the liquid pressurized and discharged from the discharge head may be further installed as the maintenance unit on the scanning start region side, and the pressure flushing reception unit may be installed aligned with the wiping unit in a direction intersecting the scanning direction.

According to the configuration, the wiping unit and the pressure flushing reception unit are disposed side by side in the direction intersecting the scanning direction, and thus a length in the scanning direction can be shortened as compared to a case in which the wiping unit and the pressure flushing reception unit are installed side by side in the scanning direction, and an increase in size of the printing apparatus can be suppressed.

In the printing apparatus described above, a liquid storage unit configured to store the liquid received by the pressure flushing reception unit may be installed on the scanning start region side.

According to the configuration, similarly to the pressure flushing reception unit, by providing the liquid storage unit on the scanning start region side, the pressure flushing reception unit and the liquid storage unit can have shorter piping that couples therebetween and be efficiently installed, and an increase in size of the printing apparatus can be suppressed.

What is claimed is:

1. A printing apparatus that is a serial-type printing apparatus, comprising:

a discharge head configured to discharge a liquid toward a medium;

a carriage configured to reciprocate in a scanning direction in a state of supporting the discharge head; and a platen configured to guide transport of the medium, wherein a maintenance unit is installed sandwiching the platen from both sides thereof in the scanning direction and configured to maintain performance of the discharge head, wherein a scanning start region that serves as a base point of scanning of the carriage is set on one side the maintenance unit sandwiching the platen in the scanning direction, wherein the maintenance unit includes a capping unit configured to cover the discharge head to suppress drying of the liquid, installed on one of the sides sandwiching the platen, a wiping unit configured to wipe the liquid adhering to the discharge head, installed on the other of the sides sandwiching the platen, and a flushing reception unit configured to receives the liquid discharged from the discharge head by performing a flushing operation, installed between the scanning start region and the platen.

2. The printing apparatus according to claim 1, wherein the maintenance unit includes the capping unit installed on the other side of the scanning start region, and the wiping unit installed on the side of the scanning start region.

3. The printing apparatus according to claim 1, wherein the wiping unit is configured as a cloth wiper, and moves in a direction intersecting the scanning direction to perform maintenance.

4. The printing apparatus according to claim 1, wherein the flushing reception unit receives the liquid discharged from the discharge head immediately before the liquid is discharged toward the medium.

5. The printing apparatus according to claim 1, wherein a pressure flushing reception unit configured to receive the liquid pressurized and discharged from the discharge head is further installed as the maintenance unit on the side of the scanning start region, and the pressure flushing reception unit is installed aligned with the wiping unit in a direction intersecting the scanning direction.

6. The printing apparatus according to claim 5, wherein a liquid storage unit configured to store the liquid received by the pressure flushing reception unit is installed on the side of the scanning start region.

* * * * *